US005520029A

United States Patent [19]

Savkar

[11] Patent Number: 5,520,029

[45] Date of Patent: May 28, 1996

[54] COIL SPRING AND SNUBBER SUSPENSION SYSTEM FOR A WASHER

[75] Inventor: Sudhir D. Savkar, Schenectady, N.Y.

[73] Assignee: General Electric Company, Schenectady, N.Y.

[21] Appl. No.: 539,889

[22] Filed: Oct. 6, 1995

[51] Int. Cl.[6] ..... D06F 37/24

[52] U.S. Cl. ..... 68/23.3; 68/23.1; 248/610; 248/638

[58] Field of Search ..... 68/23, 23.1, 23.3, 68/23.2; 248/562, 610, 638

[56] References Cited

U.S. PATENT DOCUMENTS

| | | | |
|---|---|---|---|
| 2,575,689 | 11/1951 | Smith | 68/23.5 |
| 3,616,661 | 11/1971 | Menk | 68/23.3 |
| 3,744,746 | 7/1973 | Weir et al. | 68/23.3 |
| 3,854,308 | 12/1974 | Czech et al. | 68/23.3 |
| 4,202,187 | 5/1980 | Hukuzawa et al. | 68/23.3 |
| 4,475,363 | 10/1984 | Thomson | 68/23.3 |

FOREIGN PATENT DOCUMENTS

| | | | |
|---|---|---|---|
| 54-22964 | 2/1979 | Japan | 68/23.3 |
| 63-206290 | 5/1989 | Japan | 68/23.3 |

*Primary Examiner*—Frankie L. Stinson
*Attorney, Agent, or Firm*—Paul R. Webb, II

[57] ABSTRACT

A suspension spring assembly for a washing machine employs a coil spring in compression. The suspension spring system uses a snubber mounted inside the coil spring to help dampen and isolate unbalanced load excursions by using the positive displacement pumping action of air being forced through an orifice in the snubber. A second snubber may be employed with the coil spring.

5 Claims, 2 Drawing Sheets

COIL SPRING AND SNUBBER SUSPENSION SYSTEM FOR A WASHER

RELATED APPLICATIONS

An application entitled "Washing Machine with Snubbers for Limiting Unbalanced Load Vibration Excursions" was filed on Aug. 1, 1994, as U.S. application Ser. No. 08/283,726 and still pending. The application is assigned to the same assignee as the present application.

TECHNICAL FIELD OF THE INVENTION

The present invention relates generally to a washing machine, and, more particularly, to a coil spring and snubber suspension system for a clothes washer.

BACKGROUND OF THE INVENTION

During operation of a washing machine, an unbalanced load of clothes or other articles may cause the basket to spin or rotate off-axis and may cause the tub containing the basket to vibrate. The vibration excursions tend to be especially acute during the start of the spin cycle. At the beginning of the spin cycle, the excursions may become large enough, as the machine passes through resonance of the suspension, for the tub to bang against the washer housing. As the washer spin cycle progresses, the rotational speed of the baskets increases, and the excursions tend to be limited because the clothes redistribute themselves and because the machine passes through resonance of the suspension. Stiffening the suspension will keep the tub aligned, but permanently stiffening the suspension will increase the suspension frequency causing the machine to pass through resonance at a higher, more damaging speed. Accordingly, it will be appreciated that it would be highly desirable to temporarily stiffen the washer suspension to keep the tub aligned without permanently increasing the stiffness of the suspension.

SUMMARY OF THE INVENTION

The present invention is directed to overcoming one or more of the problems set forth above. Briefly summarized, according to one aspect of the invention, a washing machine comprises a housing, a mounting platform within the housing, a tub having a vertical axis and mounted on the platform within the housing, a basket in the tub for holding articles to be washed, an agitator within the basket to facilitate washing of the articles, apparatus for imparting oscillating motion to the agitator, apparatus for rotating the basket, and a plurality of coil spring and snubber suspensions. Each suspension has a coil spring with a snubber mounted therein. The coil spring has an extension rod. The snubber sidewall defines an orifice providing a passageway for metering egress and ingress of air from the snubber cavity during a change in volume of the snubber cavity so that the resiliency of the snubber increases for high frequency excursions to thereby stiffen the coil spring body during high frequency excursions.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
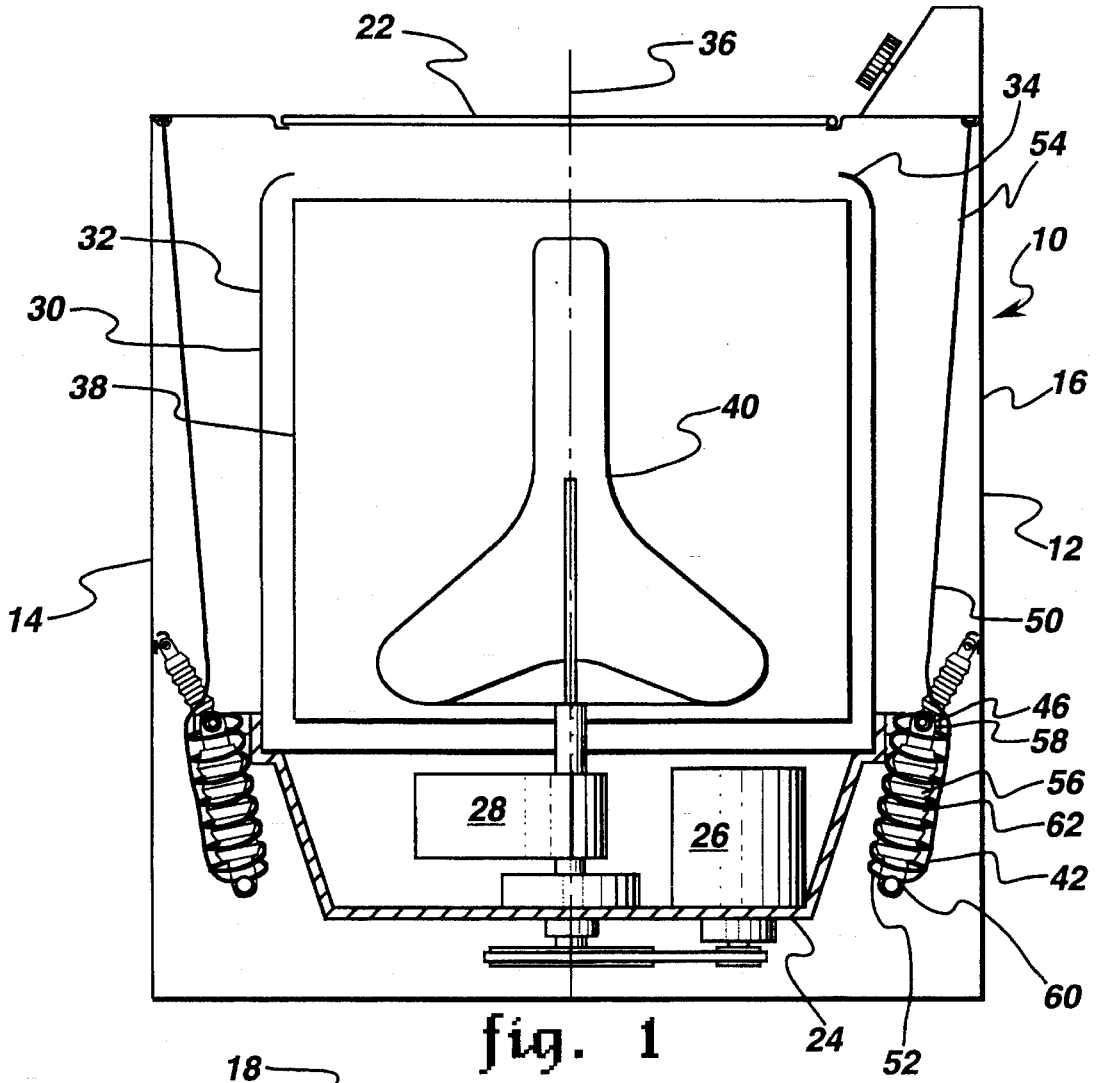
FIG. 1 is a diagrammatic side view of a washer according to the present invention with a right side panel removed to illustrate a preferred embodiment of a coil spring and snubber suspension.
Figure 2:
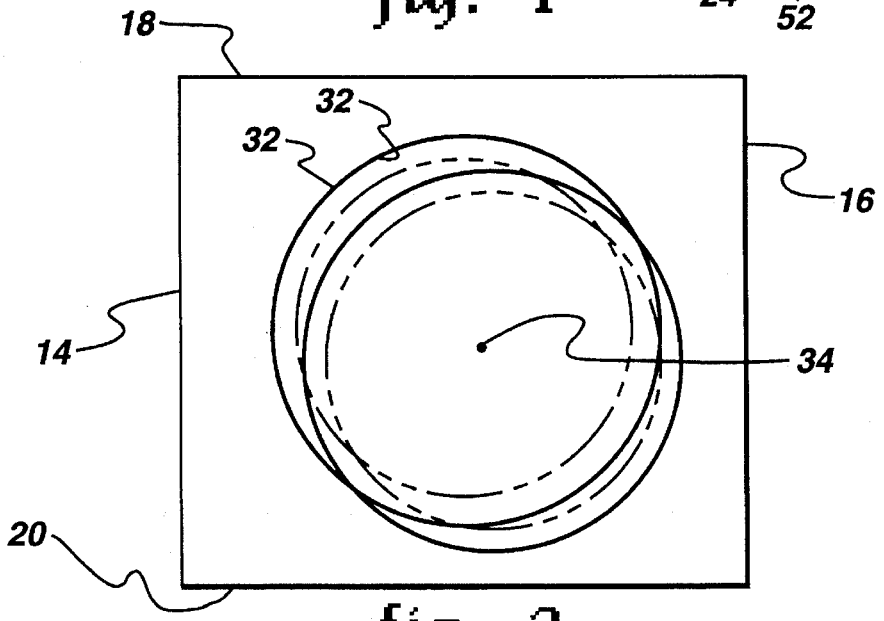
FIG. 2 is a diagrammatic top view of the washer of FIG. 1 illustrating tub excursions.

Referring to FIGS. 1 and 2, a washing machine 10, for washing a load of articles of clothing and the like, has a housing 12 containing front and rear panels, 14, 16, left and right panels 18, 20, and a top panel 22. An opening 23 is provided in top panel 22 for loading articles in machine 10. A pivotal closure panel 24 is provided for opening 23. Typically, one of the front and rear panels 14, 16 is removable for access to the interior mechanisms of the washing machine 10. Within the housing 10 is a mounting platform 25 with a motor 26, a transmission assembly 28 and a tub assembly 30 mounted thereon. As illustrated, the motor 26 and transmission 28 are positioned on a lower portion of the platform 25 while the tub 30 is mounted on the platform 25 above the motor 26 and transmission 28. As is known in the art, the transmission 28 and wash basket 38 are connected via a shaft. Positioning the transmission 28 on the platform 24 below the tub 30 lowers the center of gravity of the washer 10 which encourages more stable operation.

The tub assembly 30 has a tub 32 with a top edge portion 34 and vertical axis 36 and is positioned on the platform 25 in the housing 12 so that it is spaced from the housing panels 14, 16, 18, 20. The tub assembly 30 contains a basket 38 that is positioned in the tub 32 for holding the articles to be washed. The basket 38 contains an agitator 40 connected to the transmission 28 via a shaft. The transmission 28 transfers energy from the electric motor 26 for operating the basket 38 and agitator 40 during the various cycles of operation of the washer 10.

During a spin cycle, for example, the transmission 28 rotates the basket 38 about the vertical axis 36 in a circular path with the basket 38 remaining vertically upright when the articles to be washed form a balanced load in the basket. When the articles in the basket form an unbalanced load, the basket 38 has a tendency to rotate askew of the vertical axis 36 in a noncircular path with the basket being urged from vertical on excursions. The basket excursions urge the tub 32 from its spaced position relative to the housing panels 14, 16, 18, 20.

At the beginning of a spin cycle, when the load is unbalanced, there may be severe excursions wherein the tub contacts a housing panel. Severe excursions are not only noisy and potentially damaging to the washer, but may cause the washer to move from its position on the floor and walk across the floor, especially where the floor is weak or uneven. Accordingly, most washers are equipped with a shut down system to turn the machine off when the excursions reach a predetermined magnitude or intensity.

Figure 3:
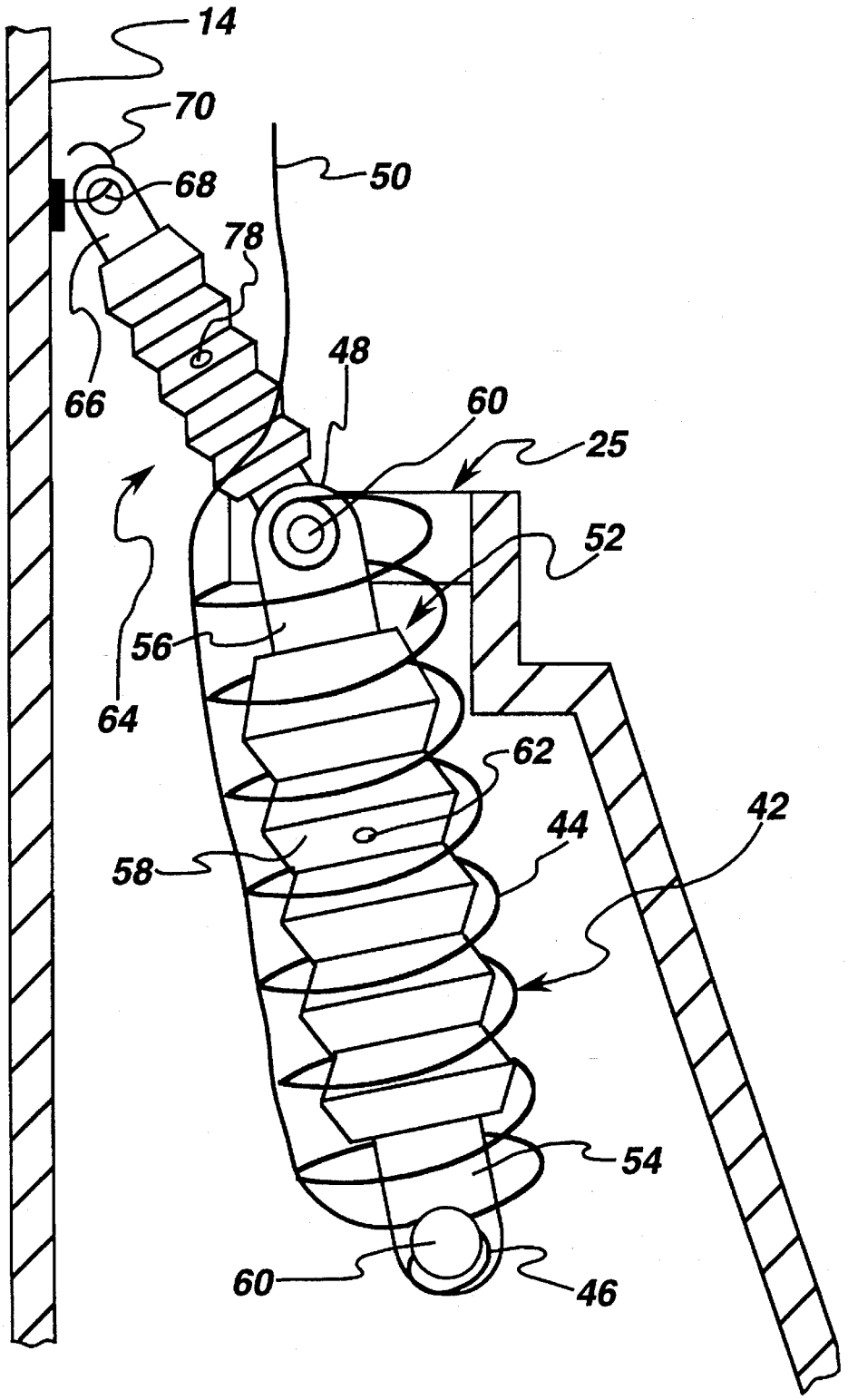
FIG. 3 is an enlarged perspective view of one of the suspensions shown in FIG. 1.

As shown in FIG. 1 and in enlarged detail in FIG. 3, a plurality of coil spring and snubber suspensions 42 provide support for tub 32 and basket 38 to minimize vibration. While two such suspensions are effective, three minimize most effectively the basket excursion effects. The three suspensions are positioned 120° apart around the tub 32. If four such suspensions are used, they are equally spaced around the tub 32 in a preferred embodiment.

Each coil spring and snubber suspension 42 has a coil spring 44 with mounting loops 46 and 48 at opposite ends thereof and an extension rod 50. A first snubber 52 is positioned inside the coil spring 44. The snubber 52 is a resilient member that has a first end portion with a mounting lug 54, a second end portion with a mounting lug 56, and a resilient middle portion 58 intermediate the end portions. Each of the lugs 54 and 56 contain an aperture 60. The snubber 52 is preferably constructed of a synthetic resinous material that can be molded into the configuration desired, such as polypropylene, for example.

Preferably, the resilient middle portion 58 of the snubber 52 has a sidewall defining a first cavity and also defining at least one orifice 62 that provides a passageway for ingress and egress of air to the cavity during a change in volume. The orifice meters the air so that the resiliency of the snubber middle portion 58 is greater for low frequency excursions than for high frequency excursions. The sidewall may be thickened around the orifice 62 for reinforcement. The orifice may be fitted with or formed with a nipple for directing the air to an out of balance load sensor which shuts down the washer during certain conditions.

Preferably, the snubber has an enclosure with walls in which the sidewall has folds, like a fan or like the bellows of an accordion, to easily accommodate the change in volume and to easily fit in the coil spring 44. The snubber may have a plurality of cavities. Where there are a plurality of cavities, more than one cavity may have an orifice. Cavities may have multiple orifices, a single orifice, or no orifice at all. Cavities not having an orifice may still change in volume by compressing or expanding the air confined therein.

The first snubber 52 is positioned inside the coil spring 44 and has its first lower end lug 54 attached to the mounting loop 46 of the coil spring 44 by a rivet through loop 46 and aperture 60 in lug 54. Other means of attachment such as a nut and bolt, can be employed. The second upper end lug 56 is attached through its aperture 60 to the mounting loop 48 of the coil spring by a rivet through loop 46 and aperture 60 in lug 56. The rivet attaches also to the upper end of the coil spring 44 to the upper edge 62 of platform 25. The extension rod 50 of suspension 42 extends from the lower end of spring coil 44 and is attached to the inner surface of top panel 22. The middle portion 58 has a sidewall defining a first cavity therein which changes in volume in response to predetermined basket excursions to thereby minimize effects of the basket excursions. The sidewall defines at least one orifice 62 providing a passageway for metering air from the cavity during a change in volume so that the resiliency of the snubber increases for high frequency excursions to thereby stiffen the coil spring body during high frequency excursions.

A second snubber 64 of the same size or different size from first snubber 52 has a first end portion with a mounting lug 64, a second end portion with a mounting lug 66, and a resilient middle portion 66 intermediate the end portions. Both lugs have an aperture 68 therein. The second snubber is made of the same material as the first snubber. The middle portion 66 has a sidewall defining a first cavity therein which changes in volume in response to predetermined basket excursions as does the first snubber. Orifice 70 provides an air passageway. The first and second snubbers may be separate units or may be integrally formed The second snubber 64 has lug 66 affixed to the inner surface of one of the washing machine panels by means, for example, of a hook 70 extending through aperture 68 and welded to the panel. The opposite end lug 64 is attached through its aperture 68 to upper lug 56 of first snubber 52 prior to riveting lugs 64 and 56, and loop 48 together and to the upper edge 62 of platform 25.

During operation, in response to large, low frequency tub excursions at the start up of a spin cycle, air in each snubber enters and exits through its orifice as the volume of the cavity changes to absorb the energy of the excursion. The second snubber limits the final volume of its cavity and the rate at which air enters and exits the cavity to control excursions. The first snubber works directly in cooperation with the coil spring. Initially, with the coil in its normal compression, a low frequency excursion tending to further compress the spring must also compress the first snubber. The first snubber is free to compress to empty its cavity, then it stiffens the spring making the spring more resistant to compression from excursions. The spring works alone for taking up compressive low frequency excursions. With the coil in its normal compression, a low frequency excursion tending to expand the spring must also expand the first snubber. The first snubber is free to expand to fill its cavity, then it stiffens the spring making the spring more resistive to expansion from excursions. The spring works alone for resisting expansive low frequency excursions. Of course, it will be understood by those skilled in the art that the resiliency of the snubber or size of the orifice or cavity may be changed to achieve a desired low frequency response with a particular coil spring.

In response to high frequency tub excursions after the start up of a spin cycle, air entering and exiting each snubber through its orifice to change the volume of the cavity to absorb the energy of the excursion is restricted by the size of the orifice. The second snubber stiffens to control high frequency excursions. The first snubber works directly in cooperation with the coil spring. Initially, with the coil in its normal compression, a high frequency excursion tending to further compress the spring must also compress the first snubber. The first snubber is not free to empty its cavity because the orifice is too small; so, it stiffens the spring making the spring more resistant to compression from high frequency excursions. With the coil in its normal compression, a high frequency excursion tending to expand the spring must also expand the first snubber. The first snubber is not free to expand to fill its cavity because the orifice is too small; so, it stiffens the spring making the spring more resistant to expansion from high frequency excursions.

While the invention has been described with particular reference to the preferred embodiments, it will be understood by those skilled in the art that various changes may be made and equivalents may be substituted for elements of the preferred embodiments without departing from invention. For example, other configurations of snubbers other than cylindrical may be used and the snubbers and spring may be attached at locations along the panels, tub and platform other than those illustrated. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the resiliency of the snubber or size of the orifice or cavity may be changed to achieve a desired high frequency response with a particular coil spring. It is accordingly intended that the claims shall cover all such modifications and applications as do not depart from the true spirit and scope of the invention.

What is claimed is:

1. A machine for washing articles, comprising:

a housing having a front panel, rear panel, top panel with opening, closure panel, left panel and right panel;

a mounting platform within said housing;

a tub having a top portion and a vertical axis and being mounted on said platform within said housing at a position spaced from each of said housing panels;

a basket in said tub having a size sufficient for holding articles to be washed;

an agitator within said basket to facilitate washing of the articles;

means for imparting oscillating motion to the agitator during a wash cycle;

means for rotating said basket, said basket rotating about said vertical axis in a circular path with said basket remaining vertical when said articles form a balanced load in said basket, said basket tending to rotate askew of said vertical axis in a noncircular path with said basket urged from vertical on excursions when said articles form an unbalanced load in said basket, said basket excursions urging said tub from said spaced position relative to said housing panels; and a plurality of coil spring and snubber suspensions each having a coil spring attached at its upper end to the mounting platform, an extension rod of the coil spring from the lower end of the coil spring attached to the upper housing panel and a snubber positioned within and attached at opposite ends to the coil spring whereby the coil spring is loaded in compression and the snubber has a cavity therein and an aperture communicating therewith which changes in volume in response to predetermined basket excursions to minimize the effects thereof.

2. A washing machine, as set forth in claim 1, wherein the plurality of suspensions comprise three suspensions which are positioned 120° apart around the tub.

3. A washing machine, as set forth in claim 1, wherein the plurality of suspensions comprise four suspensions which are equally spaced around the tub.

4. A washing machine, as set forth in claim 1, wherein a second snubber has a first end connected to the upper end of coil spring, a second end connected to said housing panel, and a resilient middle portion extending between said ends, said middle portion having a sidewall defining a first cavity therein which changes in volume in response to predetermined basket excursions to thereby minimize effects of said predetermined basket excursions.

5. A washing machine, as set forth in claim 4, wherein said first and second snubbers are integrally formed.

* * * * *